United States Patent [19]

Funk et al.

[11] 4,364,782

[45] Dec. 21, 1982

[54] PERMISSIBLE SLURRY EXPLOSIVE

[75] Inventors: Albert G. Funk; Daniel A. Wasson; Joe N. Ikeda, all of Salt Lake City, Utah

[73] Assignee: IRECO Chemicals, Salt Lake City, Utah

[21] Appl. No.: 186,371

[22] Filed: Sep. 12, 1980

[51] Int. Cl.[3] ..... C06B 45/02

[52] U.S. Cl. ..... 149/21; 149/43; 149/44; 149/61; 149/62; 149/92

[58] Field of Search ..... 149/21, 43, 44, 61, 149/62, 92

[56] References Cited

U.S. PATENT DOCUMENTS

| | | | |
|---|---|---|---|
| 3,713,918 | 1/1973 | Forshey et al. | 149/43 |
| 3,787,254 | 1/1974 | Cook et al. | 149/43 |
| 3,926,698 | 12/1975 | Cook et al. | 149/43 |
| 4,032,375 | 6/1977 | Wasson | 149/43 |
| 4,130,449 | 12/1978 | Craig | 149/43 |
| 4,216,040 | 8/1980 | Sudweeks et al. | 149/43 |
| 4,294,633 | 10/1981 | Clay | 149/43 |

*Primary Examiner*—Stephen J. Lechert, Jr.

[57] ABSTRACT

The present invention comprises a permissible aqueous blasting composition containing at least about 15% calcium nitrate as oxidizer salt. The calcium nitrate combined with water, inert material, a sensitizer, and cross linking and thickening agents forms a stable aqueous blasting composition or slurry which will meet the permissibility requirements of the U.S. Department of Labor. The use of this minimum amount of calcium nitrate particularly is effective in increasing storage stability.

13 Claims, No Drawings

PERMISSIBLE SLURRY EXPLOSIVE

The present invention relates to improved explosives of the aqueous gel or slurry type (hereinafter referred to as "aqueous blasting compositions"). More particularly, it relates to permissible aqueous blasting compositions comprised of certain essential ingredients in specified ranges of amounts, including at least about 15% calcium nitrate (CN) as oxidizer salt. The compositions of the present invention have improved physical and permissible properties over prior art compositions.

BACKGROUND OF THE INVENTION

Explosives or blasting compositions of the aqueous gel or slurry type, commonly referred to as slurry explosives or blasting agents, and referred to herein as aqueous blasting compositions, have achieved wide acceptance as commercial blasting agents owing to their low cost, safety and inherent water-resistance. Aqueous blasting compositions, containing a continuous liquid phase and comprising generally an inorganic oxidizing salt (usually predominantly ammonium nitrate (AN)), a thickening agent for the liquid phase in which some or all of the oxidizing salt is dissolved, a fuel and/or sensitizer and, optionally, other ingredients such as gassing and cross-linking agents, have been very successful even in water-containing boreholes.

An application where aqueous blasting compositions have not yet received widespread use is in the permissible explosive field. Generally, permissible explosives are those which are cap sensitive and which are relatively nonincendive so they can be used in underground mines having potentially flammable atmospheres, such as underground coal mines. Specifically, the United States Department of Labor Mine Safety and Health Administration has established detailed requirements for approval of permissible explosives for underground use. These requirements are published in 30 C.F.R. Part 15. These regulations, which are incorporated herein by reference, define permissible explosives in terms of minimum requirements, which are summarized in Table I below.

TABLE I—PERMISSIBLE EXPLOSIVES

Gallery Test 7: Incendivity in Methane-Air
*$W_{50}$>450 g
Gallery Test 4: Incendivity in Coal Dust
*W>680 g
Explosion by Influence: Propogation Across Air-Gap
Air-Gap ($1\frac{1}{4}$ inch dia.)>3.0 inches
Poisonous Gases: Volume<2.5 ft.$^3$/lb

*$W_{50}$ is the weight of explosive for 50 percent probability of ignition; W is the weight of explosive passing without a single ignition.

In addition to the requirements for permissibility, the blasting compositions must be stable, cap sensitive and have a critical diameter of 1.25 inches or less. It has been difficult for aqueous blasting compositions to meet all of these requirements simultaneously.

Heretofore, permissibles comprised conventional nitro-glycerin based granular explosives having reduced nitrate-ester content and containing sodium chloride to reduce incendivity. However, aqueous blasting compositions are much safer than the nitroglycerine explosives for permissible use. Aqueous blasting compositions are substantially more fire, friction and shock resistent and thus are less likely to produce accidental explosions. The aqueous blasting compositions of the present invention meet all of the specific and general permissible requirements and do so more effectively and economically than previous permissible aqueous blasting compositions.[1]

[1]The following U.S. Bureau of Mines publications describe prior art permissible aqueous blasting compositions:

1. Hay, J. E. et al. Development of Water-gel Permissible Explosives. Pittsburg Mines and Safety Research Center, Bureau of Mines, U.S. Dept. of Int., Pittsburg, Pa., presented at 15th International Conference on the Safety in Mines Research, Karlovy Vary, Czech., Sept. 18–21, 1973, 9 pp.
2. Mason, C. M., et al. Further Development of Nonincendive Water Gel Explosives. Explosives Research Center, Bureau of Mines, Pittsburg, Pa. (no date given), 20 pp.
3. Van Dolah, R. W., et al. Development of Slurry Explosives for Use in Potentially Flammable Gas Atmospheres. Bureau of Mines Dept. of Inv. 7195, 1968, 9 pp.
4. Watson, R. W., and Riborich, J., Recent Developments in Permissible Explosives in the USA. Pittsburg Mining and Safety Research Center, Bureau of Mines, Dept. of Int., Pittsburg, Pa., (no date given), 13 pp.

It has been found in the present invention that the use of at least about 15% by weight calcium nitrate (CN) as oxidizer salt materially enhances the properties of permissible aqueous blasting compositions. The use of CN (a) contributes water to the compositions (industrial grade CN is normally hydrated) for ease of mixing and for reduction of incendivity; (b) reduces the fudge point (salt precipitation temperature) and threreby (1) increases the sensitivity of the composition at lower temperatures and consequently reduces the need for sensitizers such as aluminum, which adversely increase the composition's incendivity and (2) avoids unnecessary heating of the solution to obtain a desired concentration of oxidizer salt; (c) accelerates the firming up or rigidification of the composition, at temperatures below its fudge point, after it is delivered or packaged, thereby preventing the segregation and separation of suspended particles in the composition and improving water resistance and sensitivity by fixing previously entrapped or otherwise incorporated gas bubbles against migration and escape; and (d) increases storage stability.

CN is particularly advantageous when used in combination with other oxidizer salts such as AN and sodium nitrate (SN). Such combination forms a eutectic, low fudge point solution which, as previously described, enhances sensitivity at lower temperatures. Moreover, even at temperatures at or below the fudge point, the salts will precipitate out of the eutectic solution in crystals of finer size than if the eutectic combination salts were not present. Thus, the use of CN, in combination with other salts, maintains these oxidizers in a more reactive physical state, even at temperatures below the fudge point.

Sensitivity is particularly important for permissibility; permissible compositions require high sensitivity, but at the same time, low incendivity. The use of CN enhances storage stability and thus reduces the amount of finely flaked aluminum particles or equivalent sensitizer required to maintain a composition cap-sensitive in small ($1\frac{1}{4}$ inch) diameters.

Another aspect of the present invention pertains to the use of CN in combination with an amine nitrate. It has been found that adequate sensitization can be obtained with as little as 1% by weight finely flaked aluminum particles in combination with at least about 25% by weight of an amine nitrate, preferrably monomethylamine nitrate. Normally, at least about 2% aluminum particles is required without the amine nitrate, even with the CN. Thus, amine nitrates can be used effectively as a sensitizer in the CN-containing permissible aqueous blasting compositions of the present invention.

In spite of all of the foregoing advantages, particularly those of significant importance to permissible explosives, and the fact that CN has been used in non-permissible aqueous blasting compositions (U.S. Pat. Nos. 3,660,181; 3,713,917; and 3,787,254), the inventors are unaware of any previous use of CN in permissible aqueous blasting compositions.

SUMMARY

The present invention relates to a permissible explosive composition comprising (a) inorganic oxidizer salt comprising at least about 15% by weight calcium nitrate; (b) from about 10% to about 35% by weight water; (c) from 0% to about 18% inert material; (d) a sensitizer comprising either (1) from about 2% to about 8% finely flaked aluminum particles or (2) a combination of from about 0.5% to about 8% finely flaked aluminum particles with from about 10% to about 40% amine nitrate; and (d) cross-linking and thickening agents.

DETAILED DESCRIPTION OF THE INVENTION

The basic concept of the present invention is the use of at least about 15% by weight CN in combination with appropriate amounts of other ingredients. As previously mentioned, the use of CN is highly advantageous in permissible aqueous blasting compositions. The percentages of CN set forth herein are in reference to industrial or commercial grade CN which contains about 14% by weight water of crystallization. An analysis of a typical commercial or fertilizer grade CN is shown in the Table below. If anhydrous CN is used, then the percentages are to be reduced proportionally. In addition to CN, the compositions of the present invention generally comprise additional inorganic oxidizer salt, optional liquid or solid fuel or both, sensitizer (which also functions as a fuel), thickener and cross-linker. Gassing agents are also normally employed.

The requirements for permissible explosives are stringent as previously mentioned, and thus the variability of the relative proportions of the various components is not as great as it is for aqueous blasting compositions in general. The proportions of each major component must be carefully chosen in order that the composition will meet the permissible requirements. It has been found in the present invention that the proportions of the major components by weight should be as follows: From about 50% to about 80% oxidizer salt; at least about 15% CN; from about 10% to about 35% water; from 0% to about 18% inert material; sensitizer comprising either from about 2% to about 8% finely flaked aluminum particles and from about 10% to about 40% amine nitrate, and thickener and cross-linker in small amounts.

The oxidizer salt or salts of which at least about 15% by weight of the total composition is CN are selected from the group consisting of ammonium and alkali metal nitrates and ammonium and alkaline earth metal nitrates. Examples of such salts are AN, SN, CN and potassium nitrate. Preferably, the oxidizer salt comprises a combination of AN and CN in preferably about equal proportions. The total oxidizer salt employed is generally from about 50% to about 80% by weight of the total composition and preferably from about 60% to about 75%.

The total amount of water present in the composition is generally from about 10% to about 35% by weight, excluding the water of crystallization of the CN. The use of water in amounts within this range will generally allow the compositions to be fluid enough to be pumped by conventional slurry pumps at elevated formulation or mixing temperatures (above the fudge point of the composition) but yet to go firm or relatively incompressible upon cooling to temperatures below the fudge point (such as room temperature) due in part to the CN reclaiming its water of crystallization upon precipitation. Although at least about 15% CN is required for compositions of the present invention, preferably from about 15% to about 45% CN is employed (including water of crystallization).

The sensitizer is finely flaked aluminum particles or a combination of such particles with an amine nitrate(s). If finely flaked aluminum particles are used alone, then they should be used in amounts of from about 2% to about 8%, in order to provide cap sensitivity but at the same time not to render the composition too incendive. The use of 15% or more CN helps reduce the amount of sensitizer needed and thus helps reduce incendivity.

Finely flaked aluminum particles suitable for use in the present invention are commonly known in the art as paint grade aluminum. The particles should be fine, have a high surface area and have a hydrophobic surface coating. Appropriately coated aluminum particles having a surface over of 0.5 $m^2/gm$ or more provide high sensitization. Commercially available paint grade aluminum powders have such characteristics and are commonly employed in aqueous blasting compositions. The finely flaked particles should have a hydrophobic coating, a size of less than about 100 Tyler mesh, and a diameter to thickness ratio of greater than about 10.

An amine nitrate(s) can be used as a sensitizer in combination with finely flaked aluminum particles. This combination sensitizer comprises from about 10% to about 40% amine nitrate, preferably monomethylamine nitrate (although dimethylamine and trimethylamine nitrate and ethanolamine nitrate, or mixtures thereof, can also be used) and from about 0.5% to about 8% aluminum. Preferably about 25% or more of the amine nitrate should be used. Ethylene glycol mononitrate can be used as an equivalent to an amine nitrate.

The above-described sensitizers also function as fuels for the oxidizer salt. The sensitizer may provide all or substantially all of the fuel requirements of the composition, or may be supplemented by other fuels.

Optionally, and in addition to the sensitizer, other solid or liquid fuels or both are employed in amounts sufficient to provide an essentially oxygen-balanced composition. Examples of solid fuels which can be used are finely divided, particulate aluminum; carbonaceous materials such as gilsonite or coal; vegetable grains such as wheat; etc. Liquid fuels may include either water-miscible or immiscible organic liquids. Miscible liquid fuels include alcohols such as methyl alcohol, glycols such as ethylene glycol, amides such as formamide, and analogous nitrogen-containing liquids. These liquids generally act as a solvent for the oxidizer salt and, therefore, can replace water to varying degrees. Immiscible liquid fuels include aliphatic, alicyclic, and/or aromatic saturated or unsaturated liquid hydrocarbons. A particularly preferred immiscible liquid fuel is No. 2 fuel oil. The total amount of additional fuel employed depends upon the amount of oxidizer salt and sensitizer present as well as the particular type of fuel used. Preferably, at least about 3% organic liquid fuel is used when the sensitizer consists of finely flaked aluminum particles. When the sensitizer is, a combination of amine nitrate and aluminum, preferably about 1% organic liquid is used.

The aqueous fluid phase of the composition is preferably rendered viscous by the addition of one or more thickening agents of the type and in the amount commonly employed in the art. Such thickening agents include guar gum; guar gum of reduced molecular weight as described in U.S. Pat. No. 3,788,909; polyacrylamide and analagous synthetic thickeners; flours and starches. The thickening agent is generally present in amounts of from about 0.05% to about 2.5%. However, flours and starches may be employed in much greater amounts, up to about 10%, in which case they also function importantly or even primarily as fuels. The examples in the Table below all contain a starch and guar gum combination as a thickener.

As is well known in the art, gassing agents are preferably employed to lower and control the density of and to impart sensitivity to aqueous blasting compositions. The compositions of the present invention preferably employ a small amount, e.g., about 0.01% to about 0.2% or more (most preferably about 0.05%), of such gassing agent in order to obtain a composition density of less than about 1.5 gm/cc. The compositions of the present invention preferably have a density of from about 0.85 gm/cc to about 1.3 gm/cc. A preferred gassing agent is a nitrite salt such as sodium nitrite, which decomposes chemically in the solution of the composition to produce gas bubbles. Mechanical agitation of the thickened aqueous phase of the composition such as obtained during mixing of the aqueous phase and the solid particulate ingredients will result in the entrainment of fine gas bubbles to produce gassing by mechanical means. Hollow particles such as hollow glass spheres, styrofoam beads and plastic microballoons are also commonly employed to effectuate a a gassified aqueous blasting composition, particularly when incompressibility is desired under high pressures. Two or more of these common gassing means may be employed simultaneously.

The compositions of the present invention are prepared by first forming a solution of the oxidizer salt and water (and miscible liquid fuel if any) having a fudge point of about 5° C. higher. The solution is prepared and maintained at an elevated temperature of about 10° C. above its fudge point. The solution is preferably prethickened by incorporation of part or all of the thickening agent. To this solution are added the remaining ingredients. These remaining ingredients are incorporated into and homogeneously dispersed throughout the solution by a mechanical stirring means as is well known in the art. The resultant explosive composition may then be transferred, e.g., pumped, while still fluid into a desired container.

Cross-linking agents for cross-linking one or more of the thickening agents are well-known in the art. Such agents are usually added in trace amounts and usually comprise metal ions such as dichromate or antimony ions.

The present invention can be better understood by reference to a number of examples. Examples A and B in the Table below disclose the formulation and detonation results of preferred compositions of the present invention. These examples have passed the permissibility tests of the United States Mine Safety and Health Administration (MSHA) and have been approved by MSHA as permissible explosives. Examples C and D disclose formulations of the present invention that have passed the permissibility tests of the Government of India.

Examples E through H compare the detonation results of compositions containing different amounts of CN. Examples E, F and G contain 0%, 5% and 10% CN, respectively, which percentages are less than the 15% required in the present invention and contained in Example H. The initial detonation results at 20° C. were similar for all four compositions; however, the final detonation results were obtained after the compositions had been temperature cycled between 5° C. and 40° C. over a period of 2 weeks. The frequency of the cycling was 48 hours and such cycling simulated the conditions of actual storage locations where temperatures often vary within this range. Thus, a comparison of detonation results before and after cycling gives a comparison of storage stability. As shown by the results, Example H, which contained 15% CN, retained good rheology and good sensitivity, after temperature cycling, whereas Examples E–G, which contained less than 15% CN, had poor rheology and poor sensitivity.

The compositions of the present invention are preferably packaged in cylindrical, stick-like form having a diameter of three inches or less. A common packaging material is polyethylene. Packaging means or apparatus are known in the art. Because the compositions are water-resistant, no burdensome precautions need be taken to prevent rupturing of the package in the presence of water. Due to their inherent high sensitivity and their ability to be further sensitized by a relatively small amount of paint-grade aluminum, the compositions can be used in a wide range of diameters.

As is well known in the art, compositions of the present invention can be formulated to have a variety of physical properties as desired. For example, the fluidity of the compositions can be varied greatly, for instance, by adjusting the relative proportions of thickener, cross-linker and liquid solvent.

Although the present invention has been described with reference to illustrative examples and preferred embodiments, various modifications will be apparent to those skilled in the art and any such modifications are intended to be within the scope of the invention as set forth in the appended claims.

TABLE

| Ingredients | Composition | | | | | | | |
|---|---|---|---|---|---|---|---|---|
| (parts by weight) | A | B | C | D | E | F | G | H |
| CN[a] | 21.5 | 19.4 | 23.0 | 23.0 | — | 5.0 | 10.0 | 15.0 |
| AN | 39.2 | 31.7 | 41.6 | 39.4 | 59.7 | 54.7 | 49.6 | 44.7 |
| NaCl | 5.5 | 5.0 | 4.4 | 5.5 | 6.4 | 6.4 | 6.4 | 6.4 |
| $H_2O$ | 17.6 | 28.4 | 15.1 | 17.8 | 22.4 | 22.1 | 21.8 | 21.4 |
| Ethylene Glycol | 5.8 | 3.8 | 5.8 | 4.6 | 3.6 | 3.6 | 3.6 | 3.6 |
| Thickeners | 6.9[b] | 4.4[c] | 7.0[d] | 5.7[e] | 4.1[f] | 4.1[f] | 4.1[f] | 4.1[f] |
| Gilsonite | 0.4 | — | 0.7 | 1.6 | — | .3 | .6 | 1.0 |
| Aluminum (paint grade) | 2.8 | 7.0 | 2.0 | 2.0 | 3.0 | 3.0 | 3.0 | 3.0 |
| Trace Ingredients[g] | 0.3 | 0.3 | 0.4 | 0.4 | 0.8 | 0.8 | 0.8 | 0.8 |

TABLE-continued

| Ingredients (parts by weight) | Composition A | B | C | D | E | F | G | H |
|---|---|---|---|---|---|---|---|---|
| Detonation Velocity, m/sec, 1¼" dia. | 3690 | 3540 | 3450 | 3100 | 3600 | 3200 | 3300 | 3000 |
| Density, g/cc. | 1.14 | 0.94 | 0.95 | 0.95 | 1.14 | 1.14 | 1.16 | 1.16 |
| Initial MB[h] at 20° C. | — | — | — | — | #2/#1 | #3/#2 | #2/#1 | #3/#2 |
| Final MB[i] at 20° C. | — | — | — | — | —/#8 | —/#8 | —/#8 | #8/#6 |
| Final rheology[j] | — | — | — | — | soft | soft | soft | normal |

[a]Fertilizer grade comprising 81:14:5 CN:$H_2O$:AN
[b]starch:guar gum = 5.1:1.8
[c]starch:guar gum = 3.0:1.4
[d]starch:guar gum = 6.0:1.0
[e]starch:guar gum = 4.6:1.1
[f]starch:guar gum = 3.0:1.1
[g]thiourea and aqueous solutions of sodium nitrite (gassing agent) and of sodium dichromate (cross-linking agent).
[h]Minimum booster (blasting cap number) required for detonation. The left number indicates detonation with the cap listed and the right number indicates failure with the cap listed.
[i]Same as "h" above except that results are after compositions have been temperature cycled from 5° C. to 40° C. for 2 weeks.
[j]After temperature cycling.

We claim:

1. A permissible explosive composition comprising:
(a) inorganic oxidizer salt comprising at least about 15% by weight calcium nitrate;
(b) from about 10% to about 35% by weight water;
(c) from 5% to about 18% inert material;
(d) from about 2% to about 8% finely flaked aluminum particles; and
(e) cross-linking and thickening agents.

2. A composition as defined by claim 1 wherein the inert material is sodium chloride.

3. A composition as defined by claim 2 wherein the composition is gassified by the use of a minor amount of a gassing agent.

4. A composition as defined by claim 3 wherein the composition contains from 0% to about 20% of a water-miscible organic liquid.

5. A composition as defined by claim 4 wherein the composition comprises:
(a) at least about 15% by weight calcium nitrate;
(b) at least 25% water;
(c) about 5% sodium chloride;
(d) at least about 3% organic liquid;
(f) thickening, cross-linking and gassing agents.

6. A composition as defined by claim 5 wherein the organic liquid is selected from the group which consists of ethylene glycol and formamide and mixtures thereof.

7. A permissible explosive composition comprising:
(a) inorganic oxidizer salt comprising at least 15% by weight calcium nitrate;
(b) from about 10% to about 35% by weight water;
(c) from 5% to about 18% inert material;
(d) from about 0.5% to about 8% finely flaked aluminum particles;
(e) from about 10% to about 40% amine nitrate; and
(f) cross-linking and thickening agents.

8. A composition as defined by claim 7 wherein the inert material is sodium chloride.

9. A composition as defined by claim 8 wherein the composition is gassified by the use of a minor amount of a gassing agent.

10. A composition as defined by claim 9 wherein the composition contains from 0% to 20% water-miscible organic liquid.

11. A composition as defined by claim 10 wherein the composition comprises;
(a) at least about 15% calcium nitrate;
(b) at least about 25% amine nitrate; and
(c) cross-linking, thickening and gassing agents.

12. A composition as defined by claim 11 wherein the amine nitrate is monomethylamine nitrate.

13. A composition as defined by claim 12 which composition contains at least about 1% water-miscible organic liquid.

* * * * *